United States Patent [19]

Wischusen, III

[11] Patent Number: 4,558,815

[45] Date of Patent: Dec. 17, 1985

[54] NESTING OPEN-TOP CONTAINERS FOR POPCORN AND THE LIKE

[75] Inventor: Henry Wischusen, III, Lilburn, Ga.

[73] Assignee: Rock-Tenn Company, Norcross, Ga.

[21] Appl. No.: 710,960

[22] Filed: Mar. 15, 1985

Related U.S. Application Data

[63] Continuation of Ser. No. 463,282, Feb. 2, 1983, abandoned.

[51] Int. Cl.[4] ..... B65D 5/24

[52] U.S. Cl. ..... 229/31 R; 229/1.5 B; 229/3.1; 229/24

[58] Field of Search ..... 229/31 R, 16 A, 410, 229/1.5 B, 24, 3.1, 16 C, 31 FS, 25, 26

[56] References Cited

U.S. PATENT DOCUMENTS

| | | | |
|---|---|---|---|
| 661,071 | 11/1900 | O'Meara | 229/31 R |
| 717,775 | 1/1903 | Single | 229/26 |
| 1,003,510 | 9/1911 | Reber | 229/31 FS |
| 1,061,531 | 5/1913 | Emmons | 229/31 R |
| 1,307,638 | 6/1919 | Pridham | 229/31 R |
| 1,383,173 | 6/1921 | Throop et al. | |
| 1,591,427 | 7/1926 | Leary | 229/16 A |
| 1,681,940 | 8/1928 | Lander | |
| 1,959,613 | 5/1934 | Carson | |
| 2,137,614 | 11/1938 | Hinkle | |
| 2,138,700 | 11/1938 | Hoff | |
| 2,145,993 | 2/1939 | Pulsifer | 229/31 FS |
| 2,158,097 | 5/1939 | Wentz | |
| 2,288,056 | 6/1942 | Wentz | 229/16 A |
| 2,307,720 | 1/1943 | Ringler | 229/31 R |
| 2,342,543 | 2/1944 | Inman | 229/16 A |
| 2,678,152 | 5/1954 | Lugt | |
| 2,823,847 | 2/1958 | Barnes et al. | 229/31 R |
| 3,146,933 | 9/1964 | Moore | |
| 3,743,169 | 7/1973 | Person | |

FOREIGN PATENT DOCUMENTS

| | | | |
|---|---|---|---|
| 938834 | 7/1962 | Denmark | 229/31 R |
| 1206768 | 8/1959 | France | 229/16 A |
| 651739 | 4/1951 | United Kingdom | 229/31 R |

*Primary Examiner*—William Price
*Assistant Examiner*—Gary E. Elkins
*Attorney, Agent, or Firm*—Jones & Askew

[57] ABSTRACT

A nesting open-top container for popcorn and the like which includes a single, substantially rectangular paperboard blank, a pair of short inner side walls joined to opposite sides of a bottom panel, a pair of outer side walls joined to the remaining opposite sides of the bottom panel, four outer side wall panel halves which are positioned in overlapping relationship in the completed container, and connecting panels which are joined to the short inner side walls and the outer side wall panel halves. The preferred embodiment may be fabricated with fewer and simpler scoring, cutting, and pre-breaking operations, produces fewer wasted die-cut portions, and avoids jamming of adjacent parts in assembly.

13 Claims, 6 Drawing Figures

NESTING OPEN-TOP CONTAINERS FOR POPCORN AND THE LIKE

This application is a continuation of application Ser. No. 463,282, filed Feb. 2, 1983 now abandoned.

TECHNICAL FIELD

The present invention generally relates to paperboard containers formed from appropriately cut and scored flat blanks, and more particularly relates to a nesting open-top container useful for holding popcorn and the like.

BACKGROUND ART

At entertainment facilities, and particularly in movie theatres, popcorn is frequently served in an open-ended container. One conventional popcorn container in heavy use is a foldable blank with locking flaps at each end which possesses a box-like shape. Such popcorn boxes are generally shipped in a flattened form to reduce shipping and handling costs, and are "popped out" to form the box when the popcorn is ready for packaging. However, the conventional popcorn box is not particularly suited for containing popcorn over which melted butter has been poured. The melted butter has a tendency to travel downwardly through the container and leak through the box flaps, thereby presenting a potential for staining the clothing of the customer.

Open-topped cup-like containers have been proposed for solving the problem of melted butter leakage. Truncated cone-shaped cups are frequently used for containing popcorn and substantially eliminate any leakage problems of butter. However, such cup-like containers, although stackable and nestable, require at least two separate and independent blanks to assemble the complete truncated cone-shaped cup, namely, a circular base member and a conical wall portion.

Another open-topped container is a nestable container as disclosed in U.S. Pat. No. 3,743,169 to Person. The container is formed from a single blank sheet by scoring and die cutting the blank, folding it into the container, and fastening panels along the seams with elongated beads of adhesive.

The open-ended container in the aforementioned patent, however, possesses a number of disadvantages. First of all, in order to form the container, six separate sets of scorings must be made. Two pairs of parallel scorings are made in order to form the base portion 12, two pairs of diagonal scorings are made to form the continuous sidewalls 13, 15, and two other separate pairs of diagonal scorings are made to form the short end walls 17, 18. Thus, the scoring machine must be set up to provide each of the six separate pairs of scorings.

Another problem with the Person container is that notched areas 31–34 must be die-cut from the blank in order to form the container. This results in the creation of paperboard waste portions which must be discarded or reused; in either case, the small waste portions must be collected and handled by the cutting equipment. This contributes to additional expense in providing equipment to handle the wastage.

It also is more difficult to pre-break the Person container because of the absence of collinear straight scoring lines which extend across the width or length of the container. The parallel scores which form the base portion do not extend to the edges of the container along the parallel lines in either direction; rather, separate diagonal scores extend from the corners of the base along diagonal lines to the edges. When the blank is pre-broken prior to assembly, difficulties are sometimes encountered in causing a blank to break along the score lines. Pre-breaking the Person blank either lengthwise or widthwise requires apparatus for holding down a portion of the blank adjacent the score line to force the pre-break to follow the score lines of the base and the diagonal. Additional complexity and expense are then required for the container-forming equipment.

Still another problem with the Person container blank is that the four adhesive strips 35–38 are not collinear. This results in the requirement that one piece of adhesive-application equipment be set up to apply the two parallel adhesive strips 37, 38, and another separate piece of adhesive-application equipment be set up to apply the diagonal adhesive strips 35, 36. Again, this contributes to the complexity and expense of the container-forming equipment.

All of the above problems when combined contribute to significantly greater expense in forming the containers, especially when it is considered that many millions of containers of this type are used yearly in the United States alone. Due to the high volumes involved, there is a long felt need for providing simpler and less expensive open-top containers which can be manufactured with fewer steps and less complex equipment.

SUMMARY OF THE INVENTION

The present invention provides a nesting open-top container for popcorn and the like which is constructed from a minimal amount of paperboard and can be fabricated quickly, efficiently, and with fewer equipment set ups for scorings, pre-breaking, and adhesive applications. Additionally, production of the preferred embodiment of the blank creates fewer die-cut wastage portions which must be handled. A first disclosed container blank embodiment has no notched cut-outs in the center area which create wastage portions, and is scored with two pairs of parallel scores and two pairs of diagonal scores, as opposed to two pairs of parallel scores and four pairs of diagonal scores in the prior art. All adhesive may be applied in collinear, straight lines, as opposed to prior art blanks which require angled adhesive applications.

A second disclosed embodiment includes a pair of notched cut-outs placed on transversely opposite longitudinal edges of the blank, which also is scored with two pairs of parallel scores and two pairs of diagonal scores as in the first embodiment. The notches create on opposite sides of the formed container a pair of troughs which overlie each other in a line extending along the side of the container from top to bottom. The overlying troughs catch any fluid such as melted butter which might be introduced into the container along the side walls.

When assembled, both embodiments of the containers of the present invention are stackable and nestable. Both blank embodiments include a pair of transverse parallel scores which extend across the width of the blank and permit pre-breaking of the blanks along the width without hold-down apparatus. The combination of a pair of parallel scores extending across the entire width of the blanks and diagonal scores defining the long side walls permits the resultant containers to be nestable, and also provides a configuration wherein the short side walls can be folded to the inside of the containers without jamming the folded corners of the short side walls into the corners of the long side walls.

Generally described, a paperboard blank for making an open-top container according to either embodiment of the present invention comprises a single, substantially rectangular blank including a first pair of scores extending transversely in the direction of the width of the blank and a second pair of scores extending longitudinally in a direction along the length of the blank between the first pair of scores. In both disclosed embodiments, the first pair of scores are parallel, as is the second pair of scores. The first pair and second pair of parallel scores define a rectangular bottom panel for the container near the center of the blank.

The blank further comprises a pair of short side walls joined to opposite sides of the bottom panel. In both disclosed embodiments, each of the short side walls is defined by the first pair of parallel scores and one of the second pair of parallel scores. A pair of outer or long side walls are joined to the remaining opposite sides of the bottom panel. Each of the outer side walls are defined by a pair of diagonal scores originating at point on the bottom panel and extending to an edge of the blank. In both disclosed embodiments, the diagonal scores originate at transversely adjacent corners of the bottom panel and extend to a transverse blank edge.

The first disclosed container blank embodiment further comprises four side wall panel halves, each being partially defined by one of the diagonal scores. Each of the side wall panel halves is further defined by a diagonal fold line originating at the same corner or point of the bottom panel as the corresponding defining diagonal score and extending between the diagonal score and a portion of one of the first pair of scores toward an edge of the blank but terminating short of the edge at a point. Each of the side wall panel halves is still further defined by a cut or slit in the blank which extends from a longitudinal edge of the blank toward the diagonal fold line and which terminates at the point of termination of the fold line.

Finally, the first disclosed embodiment of the container blank comprises four connecting panels, each being joined to one of the short side walls along one of the first pair of parallel scores, and joined to one of the side wall panel halves along one of the diagonal fold lines.

The second disclosed blank embodiment also further comprises four side wall panel halves, each being partially defined by one of the diagonal scores. Each of the side wall panel halves in the second embodiment is further defined by a diagonal fold line originating at the same corner or point of the bottom panel as the corresponding defining diagonal score and extending between the diagonal score and a portion of one of the first pair of scores towards an edge of the blank. Four connecting panels join the short side walls to the side wall panel halves along the first pair of parallel scores and along the diagonal fold lines.

Two of the connecting panels in this second embodiment, at opposite ends of one of the first pair of parallel scores, include an outer free edge which forms a notch in the blank on transversely opposite longitudinal edges. The notches are defined by a line extending from a point on one of the diagonal fold lines toward a longitudinal edge of the blank, and by a portion of the diagonal fold line also originating at the same point. The remaining two connecting panels are not notched. The combination of two connecting panels with notches and two without notches creates in the container a pair of troughs, one above the other, between each short side wall and the corresponding side wall panel halves, which catch fluid (such as melted butter) which might travel along the interior of the container. Fluid which is not caught by one trough necessarily is caught by the lower-lying trough because of the overlying relationship.

The blank of both embodiments is formed into a container by bringing the short side walls inwardly towards one another along the second pair of parallel scores to form inner side walls. Then, the two outer side walls are brought inwardly towards one another along the first pair of parallel scores. Corresponding side wall panel halves are then folded inwardly towards each other along the diagonal scores and fastened with adhesive, which has been applied along the outside of the blank (the bottom when folded as described) prior to folding. Preferably, the adhesive is applied to the side wall panel halves as well as to the short inner side walls.

When the blanks are formed into the container, each of the connecting panels is positioned between one of the short inner side walls and one of the side wall panel halves. A portion of each of the side wall panel halves is positioned in overlapping relationship with a portion of another one of the side wall panel halves, and an adhesive line along one of the side wall panel halves holds the container together.

The first disclosed embodiment of the container blank preferably further comprises four tabs which provide a surface to which the adhesive may join the short inner side walls to the side wall panel halves. The tabs in this embodiment are defined by a portion of one of the first pair of parallel scores near a longitudinal edge of the blank, and a cut slit which extends from the parallel score into one of the connecting panels and thence to the nearest longitudinal edge of the blank. When the container is formed by folding the short inner side walls inwardly towards each other along the second pair of parallel scores, the connecting panels will have a tendency to fold towards the outside of the container and into a position between the short inner side walls and the outer side wall panel halves. The tabs then overlap a portion of the side wall panel halves, and adhesive applied to the tabs joins the tabs and the side wall panel halves.

In the second embodiment of the invention, the triangular notch is cut into the blank by removing the paperboard between the line extending to the longitudinal edge and the diagonal fold line of the connecting panel. The resultant container is formed in the same manner as the first embodiment by bringing the short side walls inwardly along the second pair of parallel scores and by fastening the side wall panel halves on the outside of the container. This embodiment also allows positioning of the short side walls on the inside of the container without risking jamming the folded corners of the short side walls into the corners of the side wall panel halves and the long side walls.

Advantageously, the adhesive for holding both embodiments of the blank together as a container may be applied in collinear straight lines along the outside longitudinal edges of the blank, as opposed to prior art blanks which require that one line of adhesive be along one line along the edge and another line of adhesive be along a separate diagonally-offset line. Also, both embodiments of the present invention may be more easily pre-broken in the transverse direction without need for a separate apparatus to hold any portion of the blank because of the first pair of parallel scores which extend transversely across the entire width of the blank.

Thus, it is an object of the present invention to provide an improved nestable and stackable open-top container for popcorn and the like.

It is a further object of the present invention to provide an open-top container for popcorn and the like which can be fabricated in fewer steps and with less complex apparatus.

It is a further object of the present invention to provide an open-top container blank which may be more easily pre-broken in at least one direction without need for separate apparatus to hold down a portion of the blank.

It is a further object of the present invention to provide an open-top container blank which may be fabricated with the production of minimal amounts of waste cut-out portions formed by die-cutting.

It is a further object of the present invention to provide an open-top container blank onto which adhesive lines may be applied in straight, collinear lines as opposed to diagonally offset adhesive lines which require special equipment and set-up for application of the adhesive.

It is a further object of the present invention to provide an open-top container which includes on opposite sides of the interior of the container a pair of grease- or butter-catching troughs which vertically overlie each other and channel any fluid on the inside container walls away from the glued container seams and toward the bottom of the container.

Other objects, features, and advantages of the present invention will become apparent upon reading the following detailed description of the preferred embodiment of the invention, when taken in conjunction with the drawing and the appended claims.

DETAILED DESCRIPTION OF THE PREFERRED EMBODIMENTS

Figure 1:
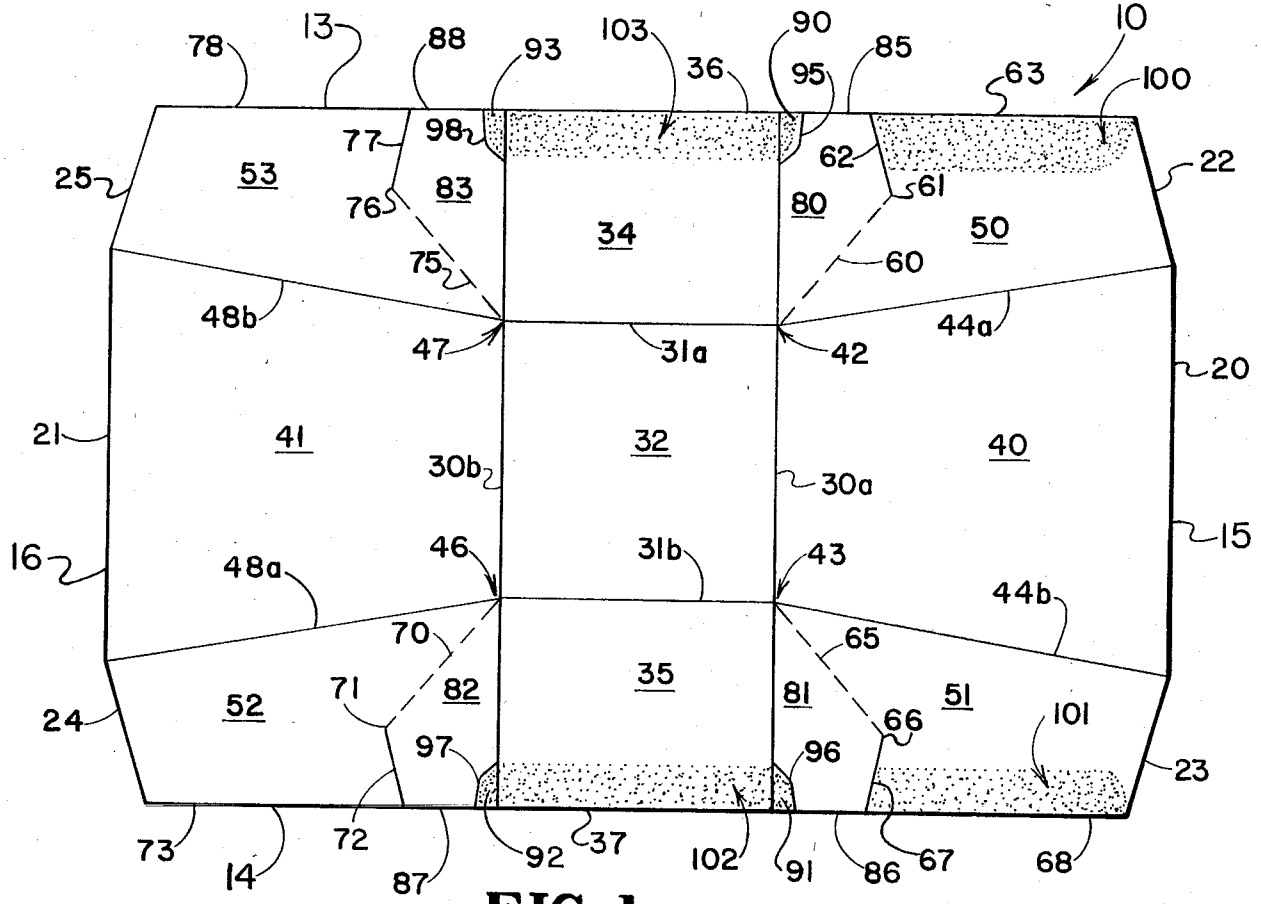
FIG. 1 is a bottom plan view of a first preferred embodiment of a cut and scored paperboard blank from which an open-top container can be formed.
Figure 3:
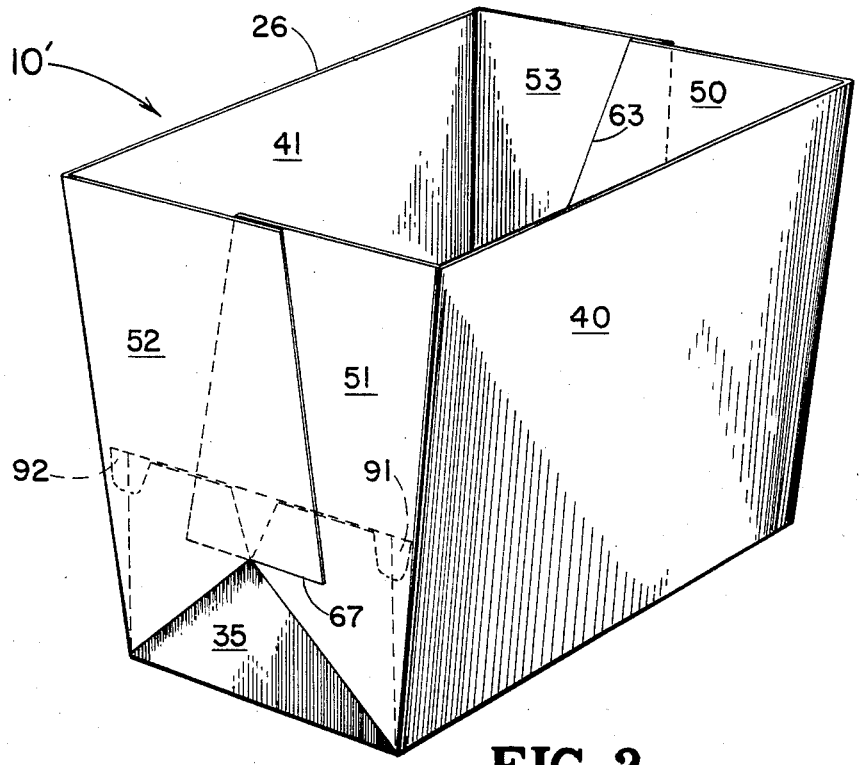
FIG. 3 is a pictorial view of the outside of a container formed from the blank shown in FIG. 1.

Referring now to the drawings, in which like numerals represent like parts throughout the several views, FIG. 1 shows the bottom side of a paperboard blank 10 which has been cut and scored in order to construct the first disclosed embodiment of the present invention. The surface of blank 10 shown in FIG. 1, being the bottom side, forms the exterior of a container such as shown in FIG. 3, it being understood that the opposite side of the blank has the same appearance but forms the interior of the container.

It will be appreciated that the blank 10 has a substantially rectangular shape which departs only slightly from a pure rectangular shape, so that almost all of the paperboard sheet is used in forming the container and waste is significantly reduced. The blank 10 may be seen to have a length and a width, the length being of a greater dimension than the width in the preferred embodiment. The blank 10 is bounded by a pair of straight collinear longitudinal edges 13, 14 which extend in the direction of the length, and a pair of transverse edges 15, 16 which extend in the direction of the width of the blank. The longitudinal edges 13, 14 in the first preferred embodiment comprise a series of contiguous, collinear edge segments, about which more will be said later. The transverse edges 15, 16 include a pair of parallel edge segments 20, 21 at opposite ends of the blank, and four diagonal edge segments 22, 23, 24, 25, all of which segments form a substantially coplanar upper edge 26, shown in FIG. 3, when the blank is formed into the container.

Preferably, the blank 10 is die cut from paperboard or cardboard which has been treated to be substantially water or grease resistant. The exterior or bottom surface as seen in FIG. 1 may have printer matter or other indicia thereon for advertising, product identification, and the like.

The blank 10 shown in FIG. 1 is scored so as to define and facilitate bending lines which allow the formation of the blank into the open-top container. In the first preferred embodiment, a first pair of parallel scores **30*a*, 30*b* extend transversely across the width of the blank from longitudinal edge 13 to longitudinal edge 14. A second pair of parallel scores 31*a*, 31*b* extend longitudinally in the direction of the length of the blank 10 between the first pair 30*a*, 30*b*. Together, the first pair and second pair of parallel scores define a rectangular bottom panel 32** near the center of the blank.

The blank 10 also includes a pair of short side walls 34, 35 which are joined to opposite sides of the bottom panel 32 along the second pair of parallel scores **31*a*, 31*b*. A first short side wall 34 is defined by segments of the first pair of parallel scores 30*a*, 30*b*, and score line 31*a*, which joins the short inner side wall 34 to the bottom panel 32. The first short side wall 34 also includes an outer longitudinal edge segment 36 which is collinear with longitudinal edge 13** of the blank.

The second short side wall 35 is defined by segments of the first pair of parallel scores **30*a*, 30*b*, and score line 31*b*, and also includes an outer longitudinal edge segment 37 which is collinear with longitudinal edge 14** of the blank.

The blank 10 further includes a pair of continuous outer or long side walls 40, 41 which are joined to the remaining opposite sides of bottom panel 32. A first outer side wall 40 is defined by a segment of score line **30*a* which extends between transversely adjacent corners 42, 43 of the bottom panel 32, and a first pair of diagonal scores 44*a*, 44*b*. Diagonal score 44*a* originates at corner 42 and extends to transverse edge 15, where it defines the juncture between diagonal edge segment 22 and longitudinal edge segment 20. Diagonal score 44*b* originates at corner 43 and extends to transverse edge 15, where it defines the juncture between diagonal edge segment 23 and longitudinal edge segment 20**.

The second continuous outer side wall 41 is defined by a segment of score line **30*b* which extends between adjacent corners 46, 47 of bottom panel 32, and a second pair of diagonal scores 48*a*, 48*b*. Diagonal score 48*a*** originates at corner 46 and extends to transverse edge 16, where it defines the juncture between longitudinal edge segment 21 and diagonal edge segment 24. Diagonal score 48*b* originates at corner 47 and extends to transverse edge 16, where it defines the juncture between longitudinal edge segment 21 and diagonal edge segment 25.

Figure 4:
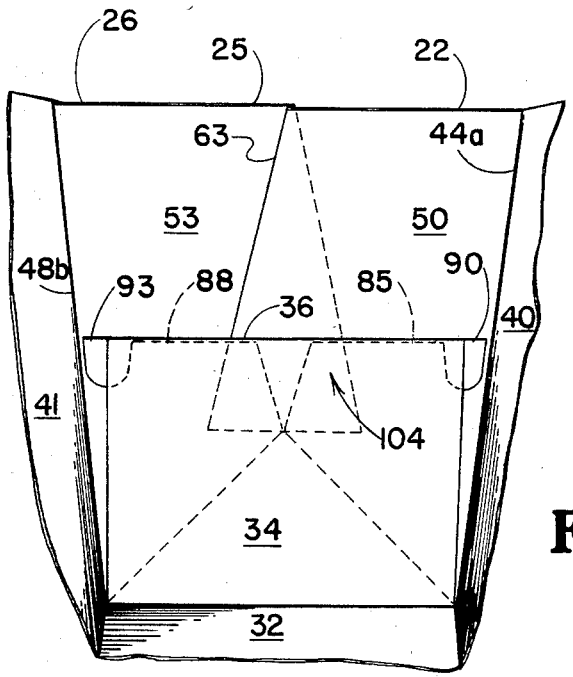
FIG. 4 is a partial pictorial view of the interior of the container shown in FIG. 3, showing the relative positions of the short inner side wall and the outer side wall panel halves.

The blank 10 further includes four outer side wall panel halves 50, 51, 52, 53, each being joined to one of the continuous outer side walls 40, 41 along one of the diagonal scores of the two pair of diagonal scores 44*a*, 44*b*, 48*a*, 48*b*. As will hereinafter be more fully apparent, and as shown in FIGS. 3 and 4, a portion of each outer side wall panel half is positioned in overlapping relationship with the portion of another outer side wall panel half in forming the completed container.

The first and second outer side wall panel halves 50, 51 are joined to the first outer side wall 40 along the first pair of diagonal scores 44*a*, 44*b*. The third outer side wall panel half 52 and the fourth outer side wall panel half are joined to the second outer side wall 41 along the second pair of diagonal scores 48*a*, 48*b*.

The first outer side wall panel half 50 is defined by diagonal score line 44*a*, and a diagonal fold line 60 which originates at corner 42 of bottom panel 32 and extends toward the longitudinal edge 13 of the blank between diagonal score line 44*a* and the segment of score line 30*a* defining the first short inner side wall 34. The diagonal fold line 60 terminates at a point 61 short of the edge of the blank. A cut or slit 62, made in the blank by a die or similar means, extends from the longitudinal edge 13 of the blank towards the fold line 60 and terminates at point 61. The first outer side wall panel half 50 is further defined by diagonal edge segment 22, and an outer longitudinal edge segment 63 which is collinear with longitudinal edge 13. It will be recalled that the diagonal edge segment 22 forms a portion of the upper edge 26 of the container.

The second outer side wall panel half 51 is defined by diagonal score line 44*b*, and a diagonal fold line 65 which originates at corner 43 and extends towards the longitudinal edge 14 of the blank between diagonal score line 44*b* and the segment of score line 30*a* defining the second short inner side wall 35. The diagonal fold line 65 terminates short of the edge of the blank at a point 66. A cut or slit 67 extends from the longitudinal edge 14 of the blank towards the fold line 65 and terminates at point 66. The second outer side wall panel half 51 is further defined by diagonal edge segment 23, which it will be recalled forms part of the upper edge 26 of the container, and outer longitudinal edge segment 68 which is collinear with longitudinal edge 14.

The third outer side wall panel half 52 is defined by diagonal score line 48*a*, and a diagonal fold line 70 which originates at corner 46 of bottom panel 32 and extends towards the longitudinal edge 14 of the blank between diagonal score line 48*a* and a segment of score line 30*b* defining the second short inner side wall 35. The diagonal fold line 70 terminates at a point 71 short of the edge of the blank. A cut or slit 72 extends from the longitudinal edge 14 of the blank towards the fold line 70 and terminates at point 71. The third outer side wall panel half 52 is further defined by diagonal edge segment 24, which it will be recalled forms a part of the upper edge 26 of the completed container, and an outer longitudinal edge segment 73 which is collinear with longitudinal edge 14.

The fourth outer side wall panel half 53 is defined by diagonal score line 48*b*, and a diagonal fold line 75 which originates at corner 47 of bottom panel 32 and extends towards the longitudinal edge 13 of the blank between diagonal score line 48*b* and a segment of score line 30*b* defining the first short inner side wall 34. The diagonal fold line 75 terminates at a point 76 short of the edge of the blank. A cut or slit 77 extends from the longitudinal edge 13 of the blank towards the diagonal fold line 75 and terminates at point 76. The fourth outer side wall panel half 53 is further defined by diagonal edge segment 25, which it will be recalled forms a part of the upper edge 26 of the container, and an outer longitudinal edge segment 78 which is collinear with longitudinal edge 13.

It will now be appreciated that a portion of the first outer side wall panel half 50 bounded by outer longitudinal edge segment 63 is positioned in overlapping relationship with a portion of the fourth outer side wall panel half 53 bounded by outer longitudinal edge segment 78 when the blank is formed into a container. Similarly, a portion of the second outer side wall panel half 51 bounded by the outer longitudinal edge segment 68 is positioned in overlapping relationship with a portion of the third outer side wall panel half 52 bounded by outer longitudinal edge segment 73 when the blank is formed into a container.

It will be further appreciated that the first preferred embodiment has a greater margin for alignment error in folding the blank into a container because of the first pair of parallel scores 30*a*, 30*b* which define the short side walls 34, 35, and the diagonal scores 44*a*, 44*b*, 48*a*, 48*b* which define the side wall panel halves. The container shown in the patents to Hoff (U.S. Pat. No. 2,138,700) and Person (U.S. Pat. No. 3,743,169), whose preferred embodiments have the short side walls folded to the outside, can experience registration or alignment difficulties if the short side walls are folded to the inside. These difficulties can occur because the edges of the short side walls in these containers are flush with the edges of other, longer side walls. Such an arrangement can result in jamming of the folded corners or edges of the short side walls into the corners of the long if the short side walls are on the inside.

In both disclosed embodiments of the present invention, there are gaps 54, 55 (FIGS. 4, 6) between the folded edges of the short side wall 34 and the side wall panel halves 50, 53, which result from the parallel scores 30*a*, 30*b* and the diagonal scores, 44*a*, 44*b*. The folded edge of the short side wall and the adjacent connecting panel is thus spaced apart from the associated corner of the side wall panel half and the adjacent long side wall. This arrangement prevents jamming of the folded corners or edges of the short side walls into the associated corners of the side wall panel halves and the adjacent long side walls.

It will also be appreciated that in the first preferred embodiment, each of the cuts or slits 62, 67, 72, 77 extend from their respective longitudinal edges at an angle of about ten degrees with respect to the first pair of parallel scores 30*a*, 30*b*, so that when the outer side wall panel halves are placed in overlapping relation, the exposed cut lines will be substantially parallel to the base of the container. For example, in FIG. 3 the exposed cut line 67 may be seen to be substantially parallel to the base of the container.

The blank 10 further includes four connecting panels 80, 81, 82, 83 which join the short side walls to the outer side wall panel halves. Each of the connecting panels is defined by a segment of one of the first pair of parallel scores 30*a*, 30*b*, one of the diagonal fold lines 60, 65, 70, 75, and one of the cuts 62, 67, 72, 77.

A first connecting panel 80 joins the first short side wall 34 to the first outer side wall panel half 50, and is defined by a segment of score line 30*a* which extends from corner 42 towards the longitudinal edge 13, diagonal fold line 60, cut 62 of the first outer side wall panel half 50, and an outer longitudinal edge segment 85 which is collinear with the longitudinal edge 13 of the blank.

A second connecting panel 81 joins the second short side wall 35 to the second outer side wall panel half 51, and is defined by a segment of score line 30*a* which extends from corner 43 towards longitudinal edge 14, diagonal fold line 65, cut 67 of the second outer side wall panel half 51, and an outer longitudinal edge segment 86 which is collinear with longitudinal edge 14 of the blank.

A third connecting panel 82 joins the second short side wall 35 to the third outer side wall panel half 52, and is defined by a segment of score line 30*b* which extends from corner 46 toward the longitudinal edge 14, diagonal fold line 70, cut 72 of the third outer side wall panel half 52, and an outer longitudinal edge segment 87 which is collinear with the longitudinal edge 14 of the blank.

A fourth connecting panel 83 joins the first short side wall 34 to the fourth outer side wall panel half 53, and is defined by a segment of score line 30*b* which extends from corner 47 toward the longitudinal edge 13, diagonal fold line 75, cut 77 of the fourth outer side wall panel half 53, and an outer longitudinal edge segment 88 which is collinear with the longitudinal edge 13 of the blank.

Figure 2:
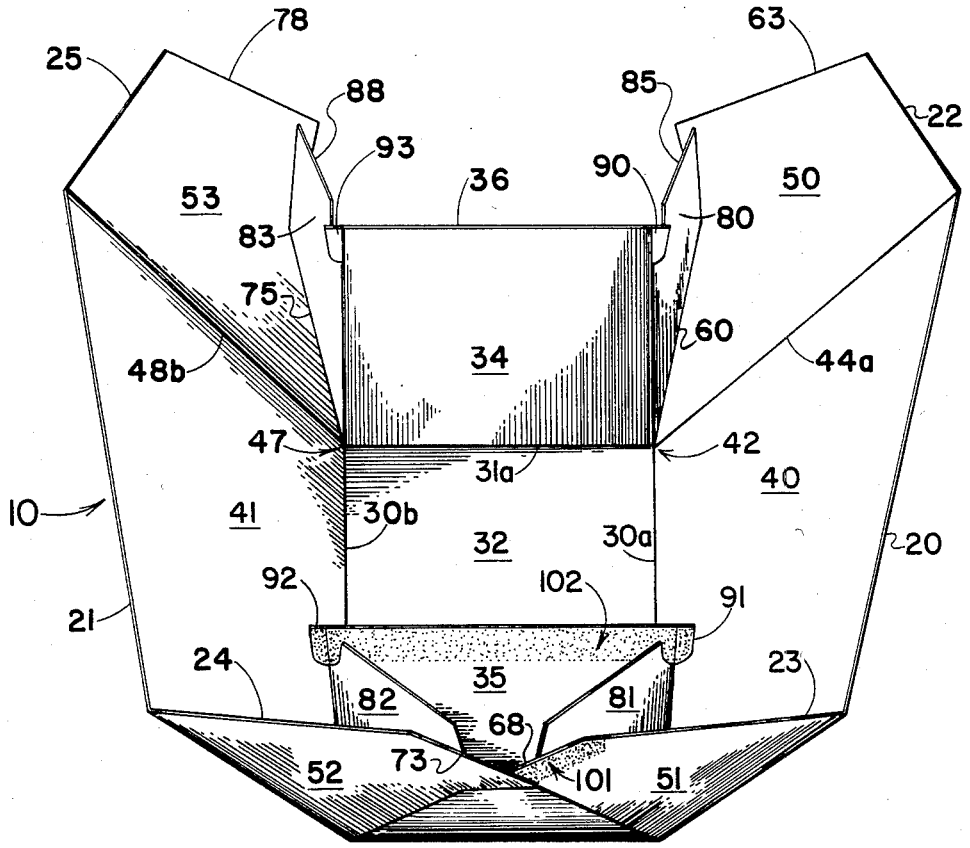
FIG. 2 is a top pictorial view of the blank shown in FIG. 1 which has been pre-broken and partially folded.

It will now be appreciated that each of the connecting panels is positioned between the short side wall and the outer side wall panel half which bound the connecting panel when the blank is formed into a container, as particularly illustrated in FIG. 2. Preferably, the short side walls 34, 35 are folded to appear on the interior of the container as inner side walls. However, it should also be understood that the short side walls can also be positioned on the outside of the container.

The first preferred embodiment of the present invention further includes four tab portions 90, 91, 92, 93 which provide a surface for adhesive to join the short side walls to the outer side wall panel halves. Two tab portions are joined to each of the short side walls along the first pair of parallel scores 30*a*, 30*b* toward the longitudinal edge segments 36, 37 of the short side walls.

A first tab portion 90 is defined by a segment of score line 30*a* which extends along the first short side wall 34, and a first tab cut 95 which extends from the longitudinal edge 13 of the blank into the first connecting panel 80 and terminates at score line 30*a*.

A second tab portion 91 is defined by a segment of score line 30*a* which extends along the second short side wall 35, and a second tab cut 96 which extends from the longitudinal edge 14 of the blank into the second connecting panel 81 and terminates at score line 30*a*.

A third tab portion 92 is defined by a segment of score line 30*b* which extends along the second short side wall 35, and a third tab cut 97 which extends from the longitudinal edge 14 of the blank into the third connecting panel 82 and terminates at score line 30*b*.

A fourth tab portion 93 is defined by a segment of score line 30*b* which extends along the first short side wall 34, and a fourth tab cut 98 which extends from longitudinal edge 13 of the blank into the fourth connecting panel 83 and terminates at score line 30*b*.

It will now be appreciated that each of the tab portions is in overlapping relationship with one of the outer side wall panel halves when the blank is folded along the score lines to form the container, as illustrated in FIGS. 2 and 4. Each of the connecting panels 80, 81, 82, 83 in the first preferred embodiment is bent when the container is formed so as to have its inner surface engage the inner surface of the adjoining outer side wall panel half, and so as to have its exterior surface engage the exterior surface of the adjoining short inner side wall. The tab portions 90, 91, 92, 93 then lie adjacent the respective outer side wall panel halves, and adhesive on the tab portions aids in holding the container together.

In order to fasten the blank into a completed container, four elongated adhesive lines 100, 101, 102, 103, seen in FIG. 1, are provided. Preferably, the adhesive lines are laid on the blank subsequent to the cutting and scoring of the blank but before bending. Adhesive line 100 extends along the outer longitudinal edge segment 63 of the first outer side wall panel half 50 and terminates at the cut 62, while adhesive line 103 extends along the outer longitudinal edge segment 36 of first short side wall 34 as well as along tab portions 90 and 93. Advantageously, adhesive lines 100 and 103 are collinear and may be applied by a single fixed adhesive applicator as the blank is run through in a direction along the length of the blank. Such an arrangement is preferable to prior art arrangements wherein lines of adhesive must be laid down diagonally to one another, requiring a movable applicator or a separate applicator. Similarly, adhesive line 101, which extends along outer longitudinal edge segment 68 of the second outer side wall panel half 51, is collinear with adhesive line 102, which extends along the outer longitudinal edge segment 37 of the second short side wall 35.

As best illustrated in FIGS. 2 and 4, the adhesive lines 102, 103 which extend along the outer longitudinal edge segments 36, 37 of the short inner side walls, are protected from heat which might cause degradation of the adhesive and diassembly of the container, by the presence of the connecting panels 80–83. This is in contrast to prior art open-top containers wherein the adhesive lines are relatively exposed to heat degredation due to the fact that the inner side walls are folded to appear on the exterior of the completed container. Indeed, at area 104 in FIG. 4 there are two layers of paperboard thickness separating the adhesive line from the exterior of the container.

The completed container 10', shown in FIG. 3, is formed by pre-breaking the blank of FIG. 1 along the first pair of parallel scores 30*a*, 30*b* (which may be done by conventional apparatus without hold-down means), and along the second pair of parallel scores 31*a*, 31*b* and the diagonal scores 44*a*, 44*b*, 48*a*, 48*b*. It will be appreciated that only a single hold-down operation is needed to pre-break the blank. This contrasts with prior art containers having only diagonal scores instead of parallel scores extending across the width and which require hold-down means to effectuate pre-breaking in all directions.

Once pre-breaking is effectuated, the long side walls 40, 41 are folded inwardly toward one another and toward the interior surface of the container, and the short side walls 34, 35 are brought toward one another and toward the inner surface of the container. The first and fourth outer side wall panel halves 50, 53 are brought together and fastened along adhesive line 100, and the second and third outer side wall panel halves 50, 52 are fastened along adhesive line 101. Adhesive lines 102, 103 then cause adhesion between the tab portions and the outer side wall panel halves, and between the short inner side walls and the connecting panels.

It will now be appreciated that each of the short side walls 34, 35, the adjacent connecting panels joined to the short side walls, and the side wall panel halves joined to the adjacent connecting panels include contiguous collinear edge segments 78, 88, 36, 85, and 63, and 73, 87, 37, 86, and 68 which define the collinear longitudinal edges 13, 14 of the blank. Such an arrangement allows enclosure of a greater volume per blank area than prior art arrangements such as shown in the patent to Hoff (U.S. Pat. No. 2,138,700), since partial overlap of side wall panel halves is possible.

Figure 5:
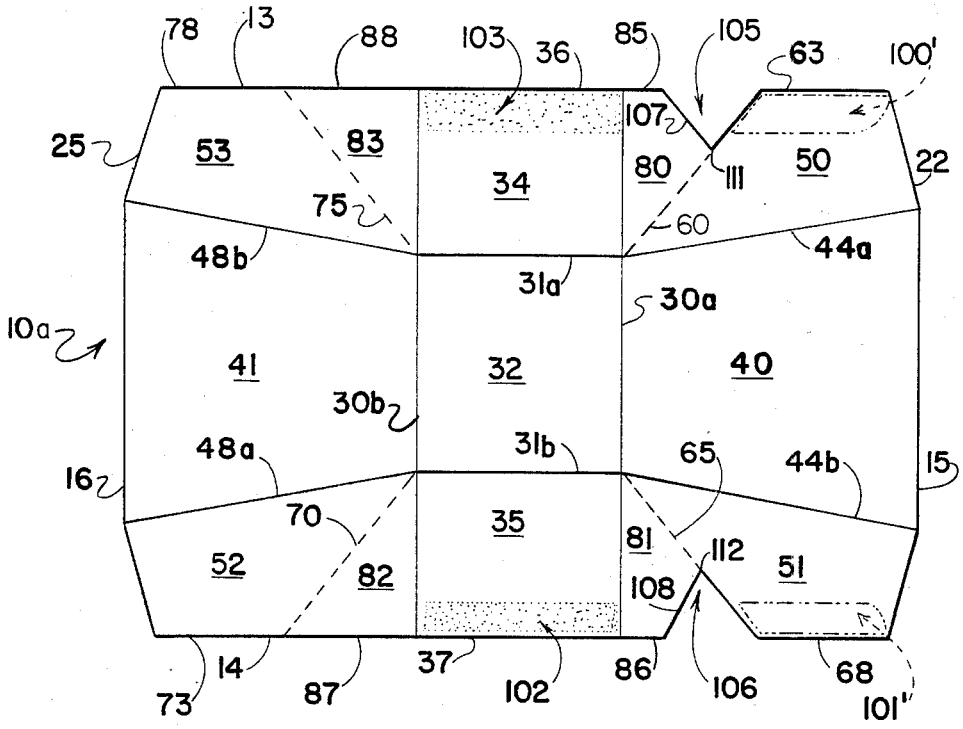
FIG. 5 is a bottom plan view of a second preferred embodiment of a cut and scored paperboard blank.
Figure 6:
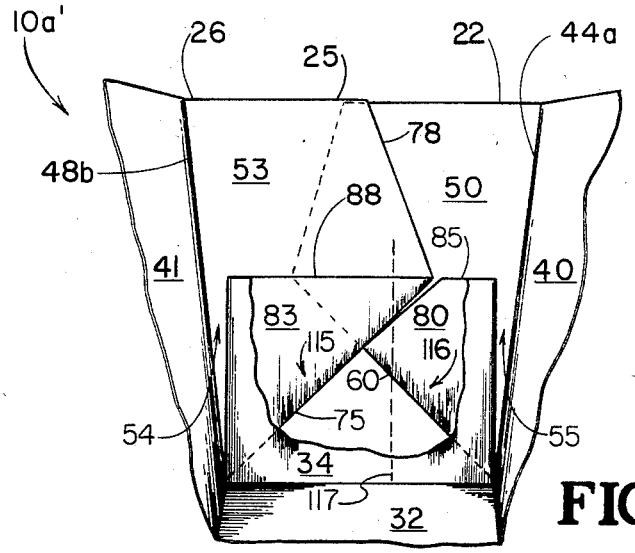
FIG. 6 is a partial cutaway pictorial view of the interior of a container made from the blank of FIG. 5.

A second preferred embodiment of the blank 10*a* is illustrated in FIGS. 5 and 6. In this alternative embodiment, transversely opposite notches 105, 106 are formed by removing the triangular area between the outer longitudinal edge segments 85, 86 of connecting panels 80, 81 and the diagonal fold lines 60, 65. Thus, diagonal fold lines 60, 65 may be designated "short" diagonal fold lines because of the removal of the paperboard, while diagonal fold lines 70, 75 may be designated "long" diagonal fold lines.

Since FIG. 5 is a bottom view, it will be seen that the adhesive for holding the container together is applied in straight lines as in the first embodiment. Preferably, adhesive lines 102, 103 are placed on the bottom or outward-facing surfaces of the inner side walls 34, 35, respectively, while adhesive lines 100', 101' are placed on the upper or inward-facing surfaces of panel halves 50, 51, respectively.

Notches 105, 106 are defined by a first line 107, 108 extending to a longitudinal edge of the blank from vertex points 111, 112 on diagonal fold lines 60, 65, respectively. Each of the first lines 107, 108 form an outer free edge of the connecting panels 80, 81. The notches 105, 106 are further defined by a second line extending along a portion of the diagonal fold lines 60, 65 from the vertex points 111, 112 to the same longitudinal edge. Preferably, the first lines 107, 108 intersect the longitudinal edges 13, 14, respectively, at a distance spaced apart from one of the first pair of parallel scores 30*a*, thereby creating longitudinal edge segments 85, 86.

In FIG. 6, it will be seen that the connecting panels and the adjacent side wall panel halves connected to the connecting panels form troughs in the assembled container 10*a'* which catch melted butter or other fluid introduced into the container and which direct the fluid into the bottom of the container. A first or long trough 115, whose crease is the long diagonal fold line 75, is formed between connecting panel 83 and outer side wall panel half 53. A short trough 116, whose crease is the short diagonal fold line 60, is formed between the connecting panel 80 and the outer side wall panel half 50.

It will be understood that the connecting panels 80, 83 will typically be fastened by adhesive line 103 to the short side wall 34, and similarly that the connecting panels 81, 82 will be fastened by adhesive line 102 to the short side wall 35. Thus, there will typically be no adhesive fastening between the side wall panel halves and the short side walls which might obstruct the flow of fluid into the troughs. However, it should also be understood that it is also possible to spot glue the connecting panels to the side wall panel halves near the edge segments 85, 88 without substantial interference with the flow of fluid into the troughs.

Due to the different lengths of the troughs 115 and 116, it will be seen in FIG. 6 that a portion of the long trough 115 vertically overlies the short trough 116 along a vertical line 117 extending from the upper edge 26 or top of the container to the bottom of the container. It will thus be appreciated that because the troughs 115, 116 overlie one another, and because the connecting panels are not fastened to the side wall panel halves, any fluid introduced into the container which travels along the sides of the containers will be diverted into one of the two troughs and thence into the bottom of the container.

The longitudinal edges 13, 14 still comprise contiguous collinear edge segments 78, 88, 36, and 85, and 73, 87, 37, and 86, respectively. The resultant container 10*a'* still possesses the advantage that problems with registration, alignment, and jamming of corners are minimized because the first pair of parallel scores 30*a*, 30*b* and the diagonal scores 44*a*, 44*b*, 48*a*, 48*b* produce the gaps 54, 55. The completed container of both embodiments possesses a frustum or truncated pyramidal shape which may be nested and stacked prior to filling with popcorn or other product.

It will thus be seen that the present invention provides a novel and improved open-top paperboard container for popcorn and the like which possesses a number of advantages over prior art containers. Not only is the amount of wastage due to the cutting of notches and the like reduced, but also fewer handling steps are required in conventional box and gluing machinery to pre-cut, score, and pre-break the blank before forming the container.

While this invention has been described in specific detail with particular reference to the disclosed embodiments, it will be understood that many variations and modifications can be effected within the spirit and scope of the invention as described in the appended claims.

What is claimed is:

1. A blank for making an open-top container for popcorn and the like, comprising:

a single substantially rectangular blank having a first pair of scores extending transversely in the direction of the width of said blank and a second pair of scores extending longitudinally in the direction of the length of said blank, said first pair and said second pair of scores defining a bottom panel near the center of said blank;

a pair of short side walls joined to opposite sides of said bottom panel, each being defined by said first pair of scores and one of said second pair of scores;

a pair of long side walls joined to the remaining opposite sides of said bottom panel, each being defined by a pair of diagonal scores originating at said bottom panel and extending to an edge of said blank;

four side wall panel halves, each being defined by one of said diagonal scores, a diagonal fold line originating at the point at which said diagonal scores intersects said bottom panel and extending between said one of said diagonal scores and a portion of one of said first pair of scores towards an edge of said blank but terminating short of said edge at a point, and a first cut line extending from a longitudinal edge of said blank toward said diagonal fold line and terminating at said point;

four connecting panels, joined to one of said short side walls along one of said first pair of scores and joined to one of said side wall panel halves along one of said diagonal fold lines, said cut lines allowing a portion of each of said side wall panel halves to be positioned in overlapping relationship with a portion of another one of said side wall panel halves, each short side wall, the adjacent connecting panels joined to said short side wall, and the side wall panel halves joined to said adjacent connecting panel halves including contiguous collinear edge segments defining a collinear longitudinal edge of said blank, and tab means attached to each of said short side walls and positionable adjacent to a surface of one of said side wall panel halves for providing a surface to which an adhesive may join said one of said short side walls to said one of said side wall panel halves;

whereby each of said connecting panels is positioned between one of said short side walls and one of said side wall panel halves, and a portion of each of said side wall panel halves is positioned in overlapping relationship with a portion of another one of said side wall panel halves when said blank is formed into a container.

2. The blank of claim 1, wherein each of said tab means is defined by a portion of one of said first pair of scores and a second cut line extending from said one of said first pair of scores into one of said connecting panels and to said longitudinal edge of said blank.

3. The blank of claim 1, wherein each one of said diagonal fold lines intersects one of said first cut lines at an obtuse angle.

4. The blank of claim 1, wherein each of said first cut lines extends at an angle of about ten degrees with respect to said fist pair of scores.

5. A blank for making an open-top container for popcorn and the like, comprising:

a single, substantially rectangular blank having a first pair of parallel scores extending transversely across the width of said blank and a second pair of parallel scores extending longitudinally in a direction along the length of said blank between said first pair, said first pair and said second pair of parallel scores defining a rectangular bottom panel near the center of said blank;

a pair of short side walls joined to opposite sides of said bottom panel, each being defined by said first pair of parallel scores and one of said second pair of parallel scores;

a pair of outer side walls joined to the remaining opposite sides of said bottom panel, each being defined by a pair of diagonal scores originating at adjacent corners of said bottom panel and extending to a transverse edge of said blank;

four side wall panel halves, each being defined by one of said diagonal scores originating at one corner of said bottom panel and extending to a transverse edge of said blank, a diagonal fold line originating at said one corner of said bottom panel and extending between said one of said diagonal scores and a portion of one of said first pair of parallel scores towards an edge of said blank, but terminating short of said edge at a point, and a first cut line extending from a longitudinal edge of said blank toward said diagonal fold line and terminating at said point, said first cut line allowing a portion of each of said side wall panel halves to be positioned in overlapping relationship with a portion of another one of said side wall panel halves;

four connecting panels, each being joined to one of said short side walls along one of said first pair of parallel scores and joined to one of said side wall panel halves along one of said diagonal fold lines, and tab means attached to each of said short side walls and positionable adjacent to a surface of one of said side wall panel halves for providing a surface to which an adhesive may join said one of said short side walls to said one of said side wall panel halves, whereby each of said connecting panels is positioned between one of said short side walls and one of said side wall panel halves, and a portion of each of said side wall panel halves is positioned in overlapping relationship with a portion of another one of said side wall panel halves when said blank is formed into a container.

6. The blank of claim 5, wherein each of said tab means is defined by a portion of one of said first pair of parallel scores and a second cut line extending from said one of said first pair of parallel scores into one of said connecting panels and to a longitudinal edge of said blank.

7. The blank of claim 5, wherein each one of said diagonal fold lines intersects one of said first cut lines at an obtuse angle.

8. The blank of claim 5, wherein each of said first cut lines extends at an angle of about ten degrees with respect to said first pair of parallel scores.

9. The blank of claim 5, wherein each short side wall and the adjacent connecting panel are folded along one of said first pair of parallel scores to form a folded edge when said blank is formed into a container, and wherein each said folded edge is spaced apart from the associated corner of a side wall panel half and the adjacent outer side wall.

10. A blank for making an open-top container for popcorn and the like, comprising:

a single substantially rectangular blank having a first pair of parallel scores extending transversely across the width of said blank and a second pair of parallel scores extending longitudinally in the direction of the length of said blank between said first pair, said first pair and said second pair of parallel scores defining a rectangular bottom panel near the center of said blank;

first and second short inner side walls joined to opposite sides of said bottom panel, each being defined by said first pair of parallel scores;

first and second outer side walls joined to the remaining opposite sides of said bottom panel, each being defined by a pair of diagonal scores, each one of said pair of diagonal scores originating at a corner of said bottom panel and extending to a transverse edge of said blank;

first, second, third and fourth outer side wall panel halves, said first and said second outer side wall panel halves being joined to said first outer side wall along a first pair of said diagonal scores, and said third and said fourth outer side wall panel halves being joined to said second outer side wall along a second pair of said diagonal scores;

said first and said fourth outer side wall panel halves, and said second and said third outer side wall panel halves, respectively, being in partial overlapping relation when said blank is formed into a container;

said first and second short inner side walls each including two tab means positionable adjacent to a surface of one of said outer side wall panel halves when said blank is formed into a container for providing a surface to which an adhesive may join each of said short inner side walls to two of said outer side wall panel halves; and first, second, third and fourth connecting panels joining one of said short inner side walls to one of said outer side wall panel halves, each of said connecting panels being defined by a portion of one of said first pair of parallel scores, a diagonal fold line originating at one corner of said bottom panel and extending between said one of said first pair of parallel scores and one of said diagonal scores toward an edge of said blank but terminating short of said edge at a point, and a cut line extending from a longitudinal edge of said blank towards said diagonal fold line and terminating at said point, said cut line allowing a portion of each of said outer side wall panel halves to be positioned in overlapping relationship with a portion of another one of said outer side wall panel halves, each of said connecting panels being positioned between one of said short inner side walls and one of said outer side wall panel halves when said blank is formed into a container.

11. The blank of claim 10, wherein each of said tab means is defined by a portion of one of said first pair of parallel scores, and by a second cut line extending from said one of said first pair of parallel scores into one of said connecting panels and to a longitudinal edge of said blank.

12. The blank of claim 10, wherein each diagonal fold line defining said connecting panels intersects one of said cut lines at said point at an obtuse angle.

13. The blank of claim 10, wherein each of said cut lines extends at an angle of about ten degrees with respect to said first pair of parallel scores.

* * * * *